United States Patent [19]

Mitani et al.

[11] Patent Number: 4,476,466

[45] Date of Patent: Oct. 9, 1984

[54] DRIVING METHOD OF GAS-DISCHARGE DISPLAY PANEL

[75] Inventors: Eisuke Mitani, Tokorozawa; Yukio Okamoto, Sagamihara; Atsushi Sumioka, Kokubunji, all of Japan

[73] Assignee: Hitachi, Ltd., Tokyo, Japan

[21] Appl. No.: 259,472

[22] Filed: May 1, 1981

[30] Foreign Application Priority Data

May 9, 1980 [JP] Japan ..... 55-60611

[51] Int. Cl.[3] ..... G09G 3/10

[52] U.S. Cl. ..... 340/805; 340/768; 340/811

[58] Field of Search ..... 340/768, 769, 770, 792, 340/805, 811

[56] References Cited

U.S. PATENT DOCUMENTS

| | | | |
|---|---|---|---|
| 3,781,600 | 12/1973 | Coleman | 340/805 |
| 3,839,713 | 10/1974 | Urade et al. | 340/792 |
| 4,080,597 | 3/1978 | Mayer et al. | 340/769 |
| 4,109,181 | 8/1978 | Murase et al. | 340/805 |
| 4,253,044 | 2/1981 | Smith | 340/768 |

*Primary Examiner*—Marshall M. Curtis

*Attorney, Agent, or Firm*—Antonelli, Terry & Wands

[57] ABSTRACT

A method of driving a gas-discharge panel having at least one reset electrode and cathode and anode groups for forming N electrode pairs. The cathodes are p-phase connected ($p \geqq 3$) while the anodes are m-phase connected ($m \leqq p$). The reset electrode is applied with a reset pulse voltage having a period of T of one frame. Cathode pulse voltages having their pulse widths of $(p-1)T/N$ are successively applied to the cathodes for respective p phases with a phase shift of T/N to each other while anode pulse voltages having their pulse widths of at maximum $(m-1)T/N$ are successively applied to the anodes for respective m phases with a phase shift of T/N to each other. A reset discharge which is generated by the reset pulse voltage and the first one of the cathode pulse voltages and anode pulse voltages applied for each frame and having a value cooperating with the reset pulse voltage value is successively transferred by means of the cathode and anode voltages to display desired information. As a result, the display luminance can be improved $(p-1)$ times without impairing the self-scanning function.

11 Claims, 7 Drawing Figures

DRIVING METHOD OF GAS-DISCHARGE DISPLAY PANEL

The present invention relates to a method of driving a gas-discharge display panel which can improve the display luminance thereof.

It has been pointed out that the display luminance of a gas-discharge display panel including a large number of electrode pairs arranged in a row is low for practical purposes. In the self-scanning method which is a typical gas-discharge display panel driving method, the duty ratio of discharge is equal to 1/N (N: the number of electrode pairs addressed within the period of one frame). Accordingly, the display luminance is decreased in inverse proportion to the number of electrode pairs. In order to solve this problem, there have been proposed a spatial divided method in which the electrode pairs are divided into a plurality of blocks for driving and another method which employs a memory panel using the difference between the breakdown voltage and the maintenance voltage. In these methods, however, as the number of electrode pairs becomes larger, the structure of the display panel becomes complicated and moreover a large scale driving circuit is required. Further, the waveform of driving pulses becomes complicated. These methods are therefore considered undesirable.

An object of the present invention made to solve the above problems is to provide a gas-discharge display panel driving method which can readily enhance the display luminance without impairing the self-scanning function peculiar to the gas-discharge display panel.

According to the present invention, there is provided a method of driving a gas-discharge display panel having (i) at least one reset electrode, (ii) first and second electrode groups for forming N electrode pairs, the electrodes of said first electrode group being p-phase connected to provide p electrode connections while the electrodes of said second electrode group being m-phase connected to m electrode connections, p being an integer not smaller than 3 and m being a positive integer not greater than p, and (iii) current limiting resistor means connected to one of said first and second electrode groups, comprising the steps of: (a) applying a reset pulse voltage with a periodicity of T of one frame to said reset electrode; (b) successively applying cathode pulse voltages with their pulse widths of $(p-1)T/N$ to the respective p electrode connections of said first electrode group with a phase shift of T/N to each other; and (c) successively applying anode pulse voltages with their pulse widths of at maximum $(m-1)T/N$ to the respective m electrode connections of said second electrode group with a phase shift of T/N to each other, whereby a reset discharge generated by said reset pulse voltage and the first one of said cathode and anode pulse voltages applied for each frame and having a value cooperating with the reset pulse voltage value is successively transferred by means of said cathode and anode pulse voltages to display desired information.

According to the present invention, a discharge time of $(p-1)T/N$ is allotted to each electrode of the first electrode group in the period T of one frame and therefore the display luminance is $(p-1)$ times as high as that obtained by the conventional self-scanning type driving method.

The present invention will now be described in conjunction with the accompanying drawings, in which.

FIG. *6a* shows the electrode arrangement and electrical connection of a gas-discharge display panel to explain a further driving method according to the present invention; and FIG. *6b* is a timing chart of the further driving method employing the display panel shown in FIG. *6a*.

Figure 1:
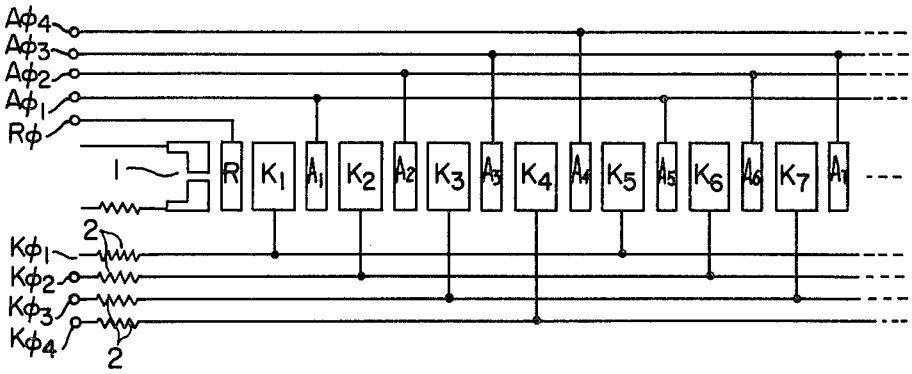
FIG. 1 shows the electrode arrangement and electrical connection of a gas-discharge display panel to explain the present invention.

Referring to FIG. 1 showing an example of the electrode arrangement of a gas-discharge display panel to which the present invention is applicable, there is exemplified the case where the 4-phase connection is made to both anodes and cathodes, that is, both the number m of phases of voltages for anodes and the number p of phases of voltages supplied for cathodes are made equal to 4.

In FIG. 1, reference numeral 1 designates a pair of keep-alive electrodes, numeral 2 current limiting resistors, symbol R a reset electrode, symbols $K_1$, $K_2$, . . . cathodes, and symbols $A_1$, $A_2$, . . . anodes. The cathodes $K_1$, $K_2$, . . . and anodes $A_1$, $A_2$, . . . are alternately arranged on the same plane in a row. Alternatively, cathodes and anodes may be arranged in a multi-layer structure. The cathodes $K_1$, $K_2$, . . . are divided into four groups in a manner that every fourth cathode is connected in common. In more detail, the cathodes $K_1$, $K_5$, etc. are connected in common to a terminal $K\phi_1$ through the current limiting resistor 2 to form the first phase connector, the cathodes $K_2$, $K_6$, etc. are connected in common to a terminal $K\phi_2$ through the current limiting resistor 2 to form the second phase connection, the cathodes $K_3$, $K_7$, etc. are connected in common to a terminal $K\phi_3$ through the current limiting resistor 2 to form the third phase connection, and the cathodes $K_4$, $K_8$, etc. are connected in common to a terminal $K\phi_4$ through the current limiting resistor 2 to form the fourth phase connection. Similarly, the anodes $A_1$, $A_2$, . . . are divided into four groups in such a manner that every fourth anode is connected in common. That is, the anodes $A_1$, $A_5$, etc. are connected in common to a terminal $A\phi_1$ to form the first phase connection, the anodes $A_2$, $A_6$, etc. are connected in common to a terminal $A\phi_2$ to form the second phase connection, the anodes $A_3$, $A_7$, etc. are connected in common to a terminal $A\phi_3$ to form the third phase connection, and the anodes $A_4$, $A_8$, etc. are connected in common to a terminal $A\phi_4$ to form the fourth phase connection. The reset electrode R is connected to a terminal $R\phi$.

Figure 3:
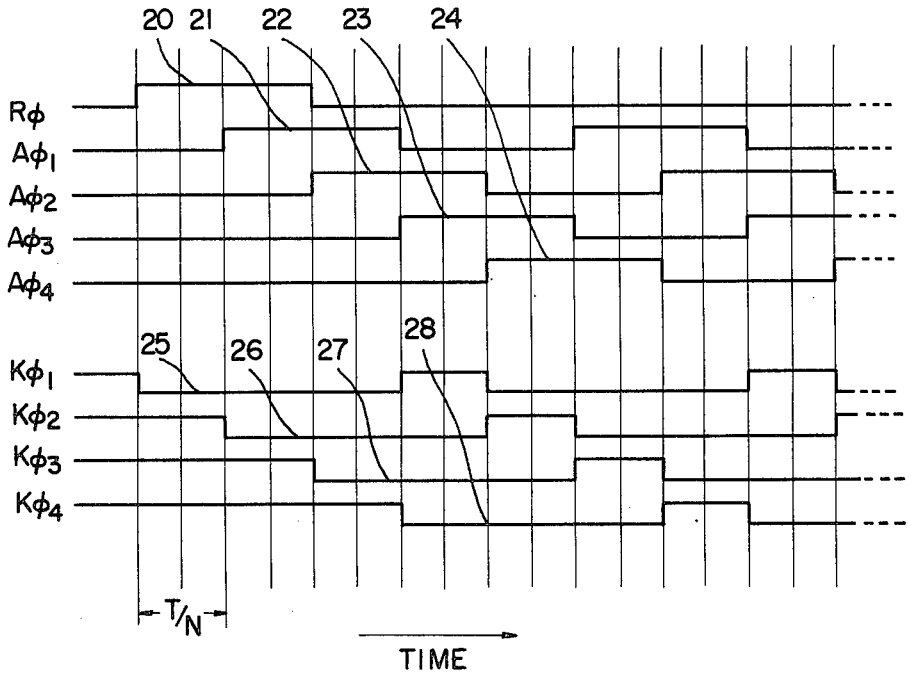
FIG. 3 shows an example of the timing chart of the driving pulse voltages generated by the circuit arrangement shown in FIG. 2.
Figure 2:
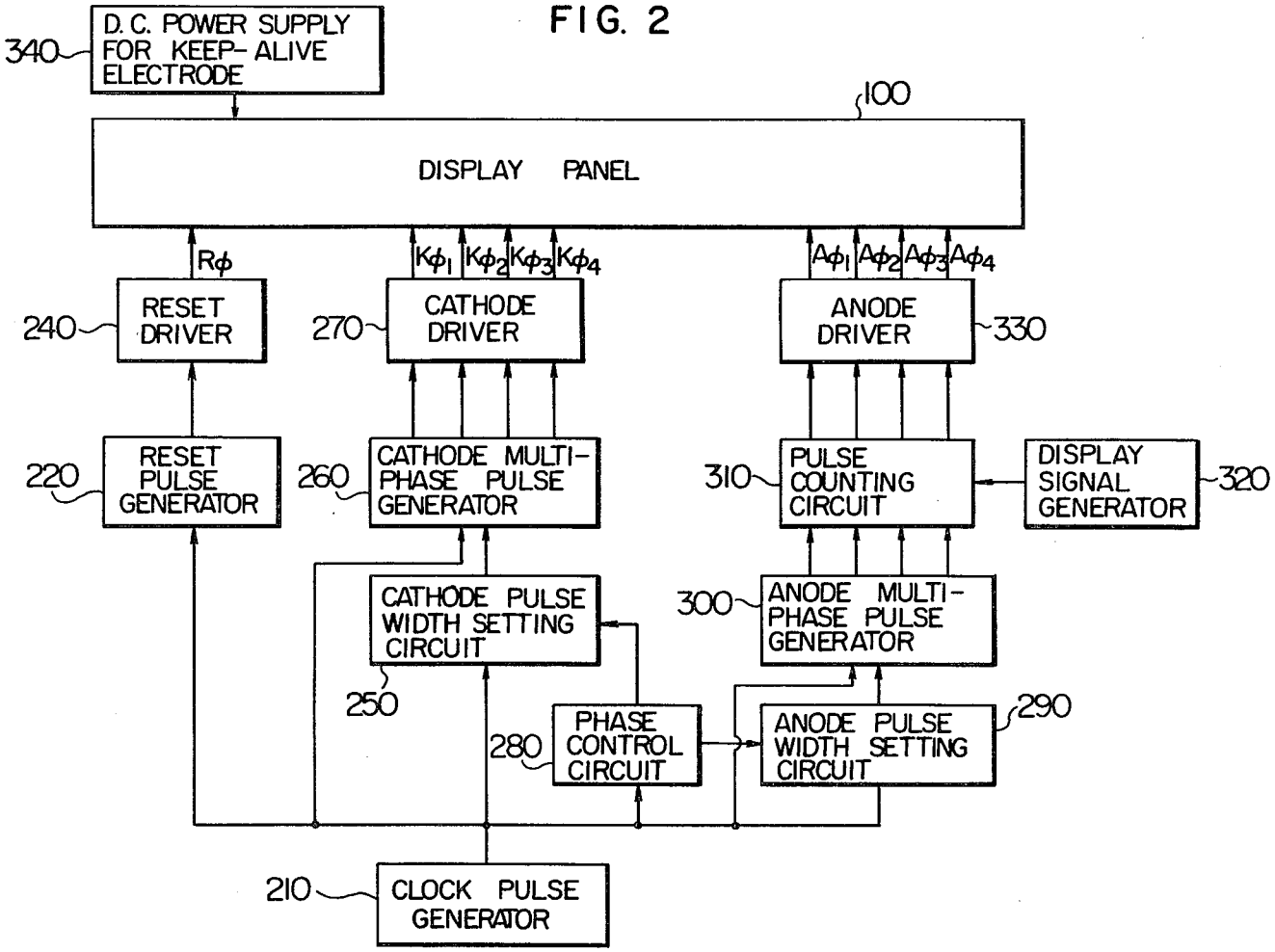
FIG. 2 is a block diagram showing a circuit arrangement for generating driving pulse voltages used in the present invention.

FIG. 2 shows in a block diagram a circuit arrangement for generating pulse voltages applied to the terminals shown in FIG. 1, and FIG. 3 shows an example of the timing of these pulse voltages. In FIG. 3, the same symbols as the terminals are shown for indicating the voltage waveforms applied to those terminals respectively. Referring to FIG. 2, a display panel 100 has such an electrode arrangement as shown in FIG. 1. A clock pulse generator 210 generates a clock pulse voltage on which the display operation is based, for example, a pulse voltage having a period of T/N and a pulse width of T/2N, where T indicates the period of one frame and N the number of electrode pairs included in the display panel 100. Usually, T is made equal to 15 ms and N is equal to 100. The output of the clock pulse generator 210 is applied to a reset pulse generator 220, a cathode pulse width setting circuit 250, a cathode multi-phase pulse generator 260, a phase control circuit 280, an anode pulse width setting circuit 290 and an anode multi-phase generator 300. The reset pulse generator 220 generates a signal for restoring the display panel 100 to its initial state at intervals of the predetermined time T, that is, counts or frequency divides the above-mentioned clock pulses to deliver a reset pulse voltage $R\phi$ with a period of T and a pulse width of 2T/N as shown in FIG. 3. The reset pulse voltage from the reset pulse generator 220 is amplified to a required voltage value by a reset driver 240 and then applied to the reset terminal $R\phi$. The cathode pulse width setting circuit 250 for adjusting the pulse width of the pulse voltage applied to each cathode generates a pulse voltage with a period of 4T/N and a pulse width of 3T/N on the basis of the above-mentioned clock pulses. The output of the cathode pulse width setting circuit 250 is applied to the cathode multi-phase pulse generator 260 to be converted into four pulse voltages whose phases are different from each other by the period T/N of the clock pulses, that is, cathode driving pulse voltages $K\phi_1$, $K\phi_2$, $K\phi_3$ and $K\phi_4$ as shown in FIG. 3. As is apparent from FIG. 3, each of the pulse voltages $K\phi_1$, $K\phi_2$, $K\phi_3$ and $K\phi_4$ has a period of 4T/N and a pulse width of 3T/N. The phase shift of each pulse voltage has a time of T/N. The thus generated cathode driving pulse voltages are amplified to required voltage values by the cathode driver 270 and then applied to the terminals $K\phi_1$, $K\phi_2$, $K\phi_3$ and $K\phi_4$ respectively. Similarly, anode driving pulse voltages are generated by the anode pulse width setting circuit 290 and the anode multi-phase pulse generator 300. In more detail, the anode pulse width setting circuit 290 generates a pulse voltage with a period of 4T/N and a pulse width of 2T/N on the basis of the clock pulses from the clock pulse generator 210. At this time, a signal from the phase control circuit 280 controls the cathode pulse width setting circuit 250 and the anode pulse width setting circuit 290 so that the pulse voltage from the anode pulse width setting circuit 290 lags the pulse voltage from the cathode pulse width setting circuit 250 by the period T/N of the clock pulses. The pulse voltage from the anode pulse width setting circuit 290 is converted by the anode multi-phase pulse generator 300 into four pulse voltages whose phses are different from each other by the period T/N of the clock pulses, that is, anode pulse voltages $A\phi_1$, $A\phi_2$, $A\phi_3$ and $A\phi_4$ as shown in FIG. 3. As is apparent from FIG. 3, each of these anode pulse voltages $A\phi_1$, $A\phi_2$, $A\phi_3$ and $A\phi_4$ has a period of 4T/N and a pulse width of 2T/N. The phase shift of each pulse voltage has a time of T/N. The number of pulses acting as each of the anode pulse voltages is limited by a pulse counting circuit 310 to a value corresponding to a display signal which is applied from a display signal generator 320 in accordance with measured data, etc. The outputs from the pulse counting circuit 310 are amplified to required voltage values by the anode driver 330 and then applied to the terminals $A\phi_1$, $A\phi_2$, $A\phi_3$ and $A\phi_4$ respectively. A d.c. power source 340 supplies a direct current to the keep-alive electrode pair to generate a normal glow discharge which facilitates the generation of a reset discharge in a region between the reset electrode R and the cathode $K_1$.

Next, explanation will be made on the operation of the display panel 100 when the pulse voltages shown in FIG. 3 are applied to the terminals shown in FIG. 1. At the beginning of each frame (having a period of T), a positive reset pulse voltage 20 having a pulse width of 2T/N is applied to the reset terminal $R\phi$ and simultaneously a first phase cathode pulse voltage 25 having a pulse width of 3T/N is applied to the first phase cathode terminal $K\phi_1$. As a result, a reset discharge is generated between the electrode R and the cathode $K_1$. After a time T/N has elapsed from the leading end of the reset pulse voltage 20, a first phase anode pulse voltage 21 having a pulse width of 2T/N is applied to the first phase anode terminal $A\phi_1$ and simultaneously a second phase cathode pulse voltage 26 is applied to the second phase cathode terminal $K\phi_2$. At this time, all of the anodes $A_1$, $A_5$, etc. connected to the first phase anode terminal $A\phi_1$ are applied with the anode pulse voltage 21 while all of the cathodes $K_2$, $K_6$, etc. connected to the second phase cathode terminal $K\phi_2$ are applied with the cathode pulse voltage 26. However, by appropriately selecting the amplitude of each of the pulse voltages 21 and 26, it is possible to generate a discharge only in a region between the anode $A_1$ and the cathode $K_2$ which is nearest to the generated reset discharge. Typically, each of the amplitudes $V_A$ and $V_K$ of the anode and cathode pulse voltages is nearly equal to 130 V, and the pulse widths of the anode and cathode pulse voltages are about 300 μs and 450 μs respectively. After a time T/N has further elapsed, a second phase anode pulse voltage 22 is applied to the second phase anode terminal $A\phi_2$, and simultaneously a third phase cathode pulse voltage 27 is applied to the third phase cathode terminal $K\phi_3$, so that a discharge is generated between the anode $A_2$ and the cathode $K_3$. At this time, the reset pulse voltage 20 terminates and therefore the reset discharge between the reset electrode R and the cathode $K_1$ vanishes. However, in the remaining or third period T/N of the cathode pulse voltage 25, the cathode pulse voltage 25 and the anode pulse voltage 21 can generate a discharge between the cathode $K_1$ and the anode $A_1$. Namely, the discharge between R and $K_1$ is transferred to the discharge between $K_1$ and $A_1$. Accordingly, in this period, discharges are simultaneously formed at both sides of the anode $A_1$, that is, between the cathode $K_1$ and the anode $A_1$ and between the anode $A_1$ and the cathode $K_2$. In a similar manner, the generation of discharge is advanced up to the fourth phase, and the operation is again returned to the first phase. Thus, a self-scanning function is provided in such a manner that the reset discharge in $R-K_1$ (between R and $K_1$) is transferred to $(K_1-A_1) \rightarrow (A_1-K_2) \rightarrow (K_2-A_2) \rightarrow (A_2-K_3) \rightarrow \ldots$, the transfer of $(A_1-K_2) \rightarrow (K_2-A_2) \rightarrow \ldots$ is made after the lapse of a T/N time from the leading end of the reset pulse voltage 20 and the transfer of $(K_2-A_2) \rightarrow (A_2-K_3) \rightarrow \ldots$ is made after the lapse of a further T/N time. It will be understood that each cathode is activated for a time 3T/N and the number of pulses applied to the anodes determines the magnitude (or position) of transfer of the discharge or how far the discharge is transferred. Instead of limiting or controlling the anode pulse number, one can employ a manner of limiting or controlling the number of pulses applied to the cathodes.

Figure 4:
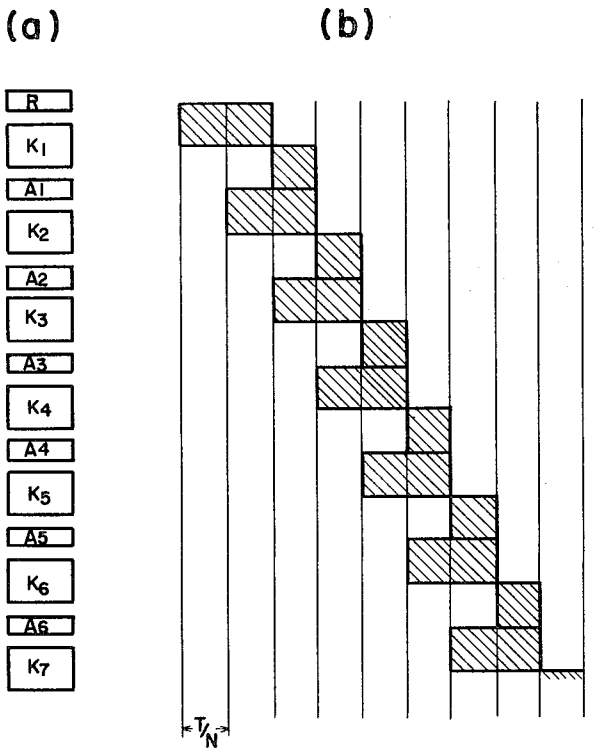
FIG. 4 is a view for explaining an operation according to the present invention.

FIG. 4 shows the above-mentioned driving method diagrammatically. In FIG. 4, a section (a) shows an electrode arrangement and another section (b) shows the pulse widths of driving pulse voltages applied to various electrodes and the phase relation between those driving pulse voltages. Hatched areas in the section (b) show the discharge times for the associated electrode pairs. Turning each of the cathodes $K_1, K_2, \ldots$, it forms a discharge with the the reset electrode R or the preceding anode for the former time interval 2T/N and a discharge with the succeeding anode for the later time interval T/N. Turning each of the anodes $A_1, A_2, \ldots$, on the other hand, it forms a discharge with the succeeding cathode for the former time interval T/N and a discharge with the preceding and succeeding cathodes for the later time interval T/N. In other words, each of the cathodes maintains the associated discharge for a time 3T/N in one frame period T so that the duty ratio of discharge is 3/N. Thus, this method can improve the display luminance three times as high as the conventional driving methods without impairing the self-scanning function.

As is apparent from the foregoing explanation, the discharge forming electrode pair is not limited to the combination of one specified anode and one specified cathode. Each cathode can form separate discharges with the anodes positioned at both sides of that cathode while each anode can form a simultaneous discharge with the cathodes positioned at both sides of that anode. Therefore, it is not required that the number of anodes is equal to the number of cathodes.

The foregoing explanation has been made on the case where both m and p are equal to 4. In general, various driving methods can be employed which will be mentioned below. When the width of a cathode pulse voltage and the difference in phase between cathode pulse voltages applied to adjacent cathodes are expressed by $t_k$ and t respectively and when the period T of one frame is given by $$T=(N-1)t+t_k, \quad (1)$$

all of cathodes included in a display panel can be applied with a pulse voltage having a pulse width $t_k$. When the phase shift t is employed as the unit to simplify the circuit contruction, the pulse width $t_k$ is given by $$t_k=Mt \quad (2)$$

and the period T is expressed as $$T=(N+M-1)t \quad (3)$$

from the equation (1) where M may be a positive real number. For the simplicity of the circuit construction, M is preferably made equal to a positive integer.

From the equations (2) and (3), the duty ratio D of the cathode pulses is given by the following equation:

$$D=t_k/T=M/(N+M-1) \quad (4)$$

When $M<<N$, the duty ratio is $D\simeq M/N$. Accordingly, the duty ratio D is M times as high as a conventional duty ratio 1/N (which corresponds to the case where M is equal to 1).

As will be mentioned later, a relation of $M=p-1$ holds between M and the number p of phases for the cathode connection. Accordingly, in the case where a p-phase connection is made to the cathodes, the duty ratio D is given by $$D=(p-1)/N.$$

That is, the display luminance can be improved by a factor of $(p-1)$.

Further, when $M\simeq N$, the duty ratio D is nearly equal to ½, and when $M>>N$, the duty ratio D becomes nearly equal to 1. However, these are not considered to be effective for the practical use. Therefore, only the case of $N<<M$ will be explained below. But, it should be noted that the results obtained in the case of $N<<M$ are similarly applicable to the case of $M\simeq N$ or $M>>N$.

The timing of the driving pulse voltage is restricted in conjunction with the self-scanning operation. In more detail, in order that the self-scanning operation can be stably performed, paired electrodes for forming discharge are required to be in a proper adjacent relation so that the interlace transfer of discharge should not be made. This requires that the cathode pulse voltage is continuous for a time Mt. On the other hand, the anode pulse voltage is not always required to be continous for the time Mt. This is because each cathode connected to the current limiting resistor 2 can hold a discharge with only one anode at a time while each anode connected to no resistor can simultaneously hold discharges with two cathodes.

Figure 5:
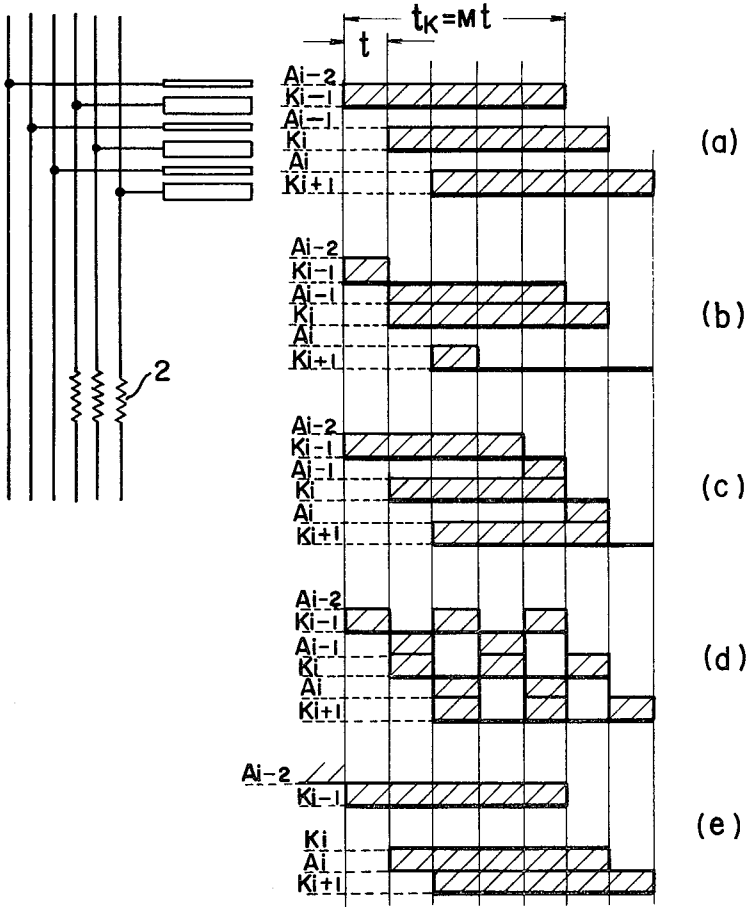
FIG. 5 is a view for explaining other driving methods according to the present invention.

FIG. 5 diagrammatically shows fundamental driving methods which meet the above-mentioned conditions and permit the self-scanning operation. In FIG. 5, the left half shows that part of the electrode arrangement of a display panel which includes a cathode $K_i$, and each of (a) to (e) show the pulse widths of pulse voltages applied to electrodes and the phase relation between the pulse voltages in such a manner that each thin solid line and each thick solid line indicate the timing of anode pulse voltage and that of cathode pulse voltage respectively. Each hatched area indicates the discharge time for the associated electrode pair. As is apparent from FIG. 5, it is desirable to use the phase shift t between cathode pulse voltages as the unit in determining not only the pulse width of cathode pulse voltage but also the pulse width of anode pulse voltage. Next, the driving methods shown in (a) to (e) of FIG. 5 will be explained below in detail.

In the driving method shown in (a) of FIG. 5, anode and cathode pulse voltages are synchronized with each other, the pulse width of each of anode and cathode pulse voltages is Mt and the phase shift between anode pulse voltages and that between cathode pulse voltages are both equal to t. Accordingly, the period of anode pulse voltage and that of cathode pulse voltage are equal to $(M+1)t$.

In the driving methods shown in (b) to (e) of FIG. 5, the conditions for cathode pulse voltages are the same as those in (a). That is, each cathode pulse voltage has a pulse width of Mt, a period of $(M+1)t$ and the phase shift of t. Therefore, explanation of cathode pulse voltages will be omitted in the following description with respect to the driving methods shown in (b) to (e) of FIG. 5.

Referring to the driving method shown in (b) of FIG. 5, two kinds of anode pulse voltages are employed, one of which has a pulse width of t and the other a pulse width of Mt. Accordingly, the discharge condition is determined by the cathodes. For example, when the anode pulse voltage having a pulse width of t is applied to anode $A_{i-2}$ and $A_i$ and the anode pulse voltage having a pulse width of Mt is applied to an anode $A_{i-1}$, a cathode $K_i$ holds a discharge with the anode $A_{i-1}$ during the pulse duration Mt while a cathode $K_{i-1}$ (or $K_{i+1}$) holds a discharge with the anode $A_{i-2}$ (or $A_i$) for the first time interval t of the pulse duration Mt and holds a discharge with the anode $A_{i-1}$ (or $A_{i+1}$) of the remaining time interval (M−1)t. The phase shift between anode pulse voltages is equal to t and the maximum pulse width of anode pulse voltage is equal to Mt. Accordingly, the period of anode pulse voltage is required to be at least (M+1)t.

In the driving method shown in (c) of FIG. 5, the pulse width of anode pulse voltage is equal to (M−1)t and the phase shift between anode pulse voltages is made equal to t. Accordingly, the period of anode pulse is required to be Mt. The example shown in FIG. 4 corresponds to the case where M is made equal to 3 in the driving method shown in (c) of FIG. 5.

In the driving method shown in (d) of FIG. 5, the pulse width of anode pulse voltage is equal to t. Discharge is formed between a cathode $K_i$ and an alternate one of anodes $A_{i-1}$ and $A_i$ at intervals of t for a time Mt. The phase shift between anode pulse voltages is equal to t and the period of anode pulse voltage is 2t.

In the driving method shown in (e) of FIG. 5, the pulse width of anode pulse voltage is equal to (M+1)t. In this case, the number of anodes may be one-half of that of cathodes. The phase shift between anode pulse voltage is equal to 2t, and the period of anode pulse voltage is (M+2)t.

As can be known from the above explanation, these driving methods have some connection with the structure of the display panel, specifically, the number m of phases employed for anode connection and the number p of phases employed for cathode connection. The number of phases is defined by the period of pulse voltage applied to the electrodes. In more detail, since the cathode pulse voltage has a pulse width of Mt and the phase shift between cathode pulse voltages is t, at least (M+1) lead wires are required to apply the cathode pulse voltage having a pulse width of Mt to all the cathodes. Since this number of lead wires corresponds to the number p of phases, one can obtain p=M+1 or M=p−1. This value p=M+1 coincides with the coefficient of the period (M+1)t of cathode pulse voltage.

Similar relation is obtained with respect to anodes. Since the coefficient of the period of anode pulse voltage is equal to (M+1), (M+1), M, 2 and (M+2) in respective cases shown in (a) to (e) of FIG. 5, the number m of phases for anode connection is required to be at least (M+1), (M+1), M, 2 and (M+2) in the respective cases. Since the number p of the phases for cathode connection is equal to (M+1), as mentioned previously, the number m of phases for anode connection is equal to p, p, (p−1), 2 and (p+1) in the respective cases of FIG. 5.

Now, let us assume that M is selected to be an integer greater than 1 in order to increase the duty ratio of discharge. Then, the minimum value of the number m of phases for anode connection is 2 and the minimum value of the number p of phases for cathode connection is 3. Accordingly, the duty ratio of discharge can be improved by employing at least a two-phase connection for anodes and at least a three-phase connection for cathodes.

Figure 6A:
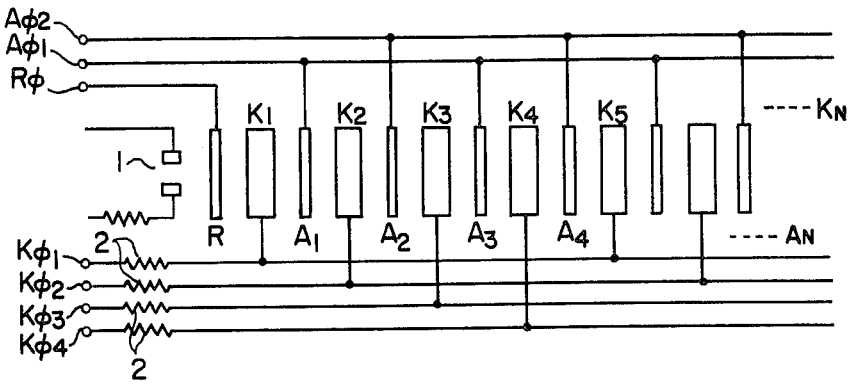
Figure 6B:
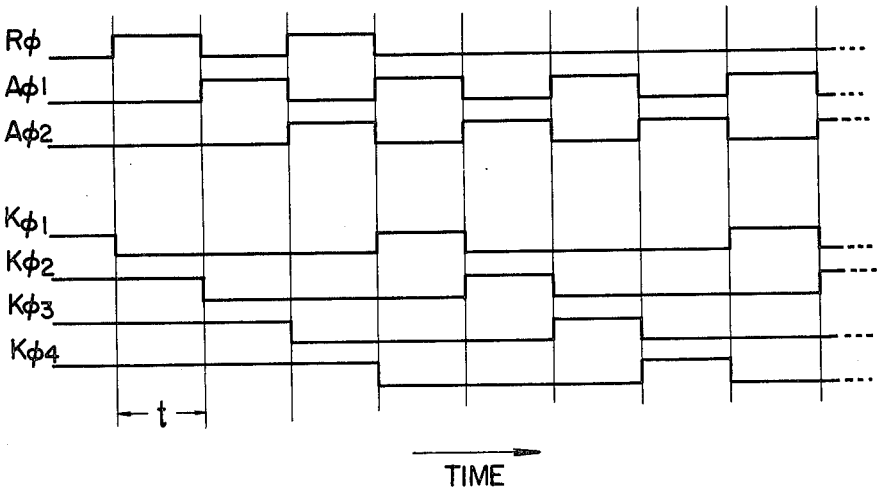

FIG. 6*a* shows the structure of a display panel in which the number m of phases for anode connection is 2 and the number p of phases for cathode connection is 4, and FIG. 6*b* is a timing chart of driving pulse voltages used in the display panel shown in FIG. 6*a*. The driving pulse voltages shown in FIG. 6*b* can be readily obtained by making some modification to the anode pulse width setting circuit 290 and anode multiphase pulse generator 300 shown in FIG. 2. The driving condition of FIG. 6*b* corresponds to the case where M is made equal to 3 in the driving method shown in (d) of FIG. 5. In (d) of FIG. 5, the number m of phases for anode connection and the pulse width of anode pulse voltage can be made equal to 2 and t respectively, independently of the value of M. Accordingly, the luminance modulation can be readily achieved by merely changing the number p of phases for cathode connection and the pulse width of cathode pulse voltage.

The foregoing description has been made with respect to the cases where various pulse voltages are applied to the anodes. In principle, however, the display panel can be driven by a d.c. anode voltage. In this case, the number of phases used for anode connection is equal to 1.

In the foregoing explanation, the phase shift t between cathode pulse voltages has been given by $$t=T/(N+M-1).$$

However, since N is usually much greater than M, t is nearly equal to T/N.

The features of the present invention can be summarized as follows:

(1) When an m-phase connection (m: positive integer) and a p-phase connection (p: integer not smaller than 3) are made to anodes and cathodes respectively and the number of electrode pairs and the period of one frame are N and T respectively, a discharge time of (p−1)T/N is allotted to each cathode.

(2) The anode pulse voltage has a maximum pulse width of (m−1)T/N, and the cathode pulse voltage has a pulse width of (p−1)T/N.

(3) Unlike driving pulse voltages employed in the conventional self-scanning scheme, cathode pulse voltages for different phases co-exist for a predetermined time interval. (The phase shift between cathode pulse voltages is T/N.)

Next, explanation will be made of a few items from the instrumental point of view.

When an m-phase connection and a p-phase connection are made to anodes and cathodes respectively, it is possible to provide an operation equivalent to any phase number smaller than m or p by changing the waveform of driving pulse voltages. For example, when m and p are 2 and 4 respectively, the application of cathode pulse voltages with a width of 2t (that is, M=2) and the phase shift of t in place of the cathode pulse voltages having a pulse width of 3t (that is, M=3) to the respective cathodes changes the duty ratio of discharge from 3/N to 2/N. Similarly, the application of a cathode pulse voltage having a pulse width of t (that is, M=1) provides the duty ratio of 1/N. The circuit arrangement for providing these operations is readily available to those skilled in the art. Such operations allow the luminance modulation. Some change may be required to anode pulse voltages, but it offers no essential problem.

In the operation of refresh mode, the reset discharge (that is, the discharge between R and $K_1$ shown in FIGS. 1 and 4) has to be formed at the beginning of each frame. The reset pulse is usually in phase with the anode pulse voltage for the last phase. (When an m-phase connection is made to anodes, the anode pulse voltage of the first phase is applied to anodes $A_1$, $A_{m+1}$, etc., and the anode pulse voltage of the m-th or last phase is applied to anodes $A_m$, $A_{2m}$, etc.) Therefore, one pulse of the anode pulse voltage of the last phase is applied to the reset electrode R at the beginning of each frame. For example, in the case shown in (d) of FIG. 5, the anode pulse having a width of t is intermittently applied to the electrode R, as indicated by the reset pulse voltage $R\phi$ in FIG. 6*b*. Such an intermittent application is not always required, but the number of pulses applied to the reset electrode R may be within a range from 1 to p/2. In this case, the discharge time allotted to the cathode $K_1$ is not $M_t$, but the self-scanning operation can be performed without a hitch in the display panel. Further, in certain cases, a change may be required to the first cathode pulse voltage of the first phase in conjunction with the reset pulse, but such a change provides no essential problem in operation.

The foregoing description has been made with respect to the cases where the current limiting resistors 2 are connected to the cathodes. Alternatively, the anodes can be connected to the current limiting resistors without impairing the self-scanning function.

According to the present invention, display control can be made not only in an analog fashion but also in a digital fashion. In the digital control, the phase shift t between cathode pulse voltages is usually employed as a unit.

A d.c. voltage may be superposed on at least one of the anode and cathode driving pulse voltages to make the margin operation greater.

What is claimed is:

1. A method of driving a gas-discharge panel having (i) at least one reset electrode, (ii) first and second electrode groups for forming N electrode pairs, the electrodes of said first electrode group being wired in a p-phase connection and the electrodes of said second electrode group being wired in an m-phase connection, p being an integer of $3 \leqq p \leqq N$ and m being a positive integer not greater then p, and (iii) current limiting resistor means connected to one of said first and second electrode groups, comprising the steps of:

(a) applying at least one reset pulse voltage having a maximum pulse width of $(m-1)T/N$ to said reset electrode at the beginning of each frame of period T, the reset pulse voltage having a predetermined value with respect to a reference value;

(b) successively applying cathode pulse voltages with their pulse widths of $(p-1)T/N$ to the respective p-phase electrode connections of said first electrode group with a phase shift of T/N to each other, the cathode pulse voltages having a value smaller than the reference value; and (c) successively applying anode pulse voltages with their maximum pulse width of $(m-1)T/N$ to the respective m-phase electrode connections of said second electrode group with a phase shift of T/N to each other, the anode pulse voltages having a value larger than the reference value, said anode and cathode pulse voltage values differing from said reference value sufficiently to support discharge, whereby a reset discharge generated by said reset pulse voltage and the first one of said cathode and anode pulse voltages applied for each frame is successively transferred by means of said cathode and anode pulse voltages to display desired information.

2. A method according to claim 1, wherein m is equal to p and each of said anode pulse voltages has a pulse width of $(p-1)T/N$.

3. A method according to claim 1, wherein m is equal to p and said anode pulse voltages having pulse widths of T/N and $(p-1)T/N$ are alternately applied to the respective electrode connections of said second electrode group.

4. A method according to claim 1, wherein m is equal to p and each of said anode pulse voltages has a pulse width of $(p-2)T/N$.

5. A method according to claim 4, wherein p and m are both equal to 4 and each of said cathode pulse voltages has a pulse width of 3T/N while each of said anode pulse voltages has a pulse width of 2T/N.

6. A method according to claim 1, wherein m is equal to $(p-1)$ and each of said anode pulse voltages has a pulse width of $(p-2)T/N$.

7. A method according to claim 1, wherein m is equal to 2 and each of said anode pulse voltages has a pulse width of T/N.

8. A method according to claim 7, wherein the pulse width of said cathode pulse voltage is varied to provide a luminance modulation.

9. A method according to any one of claims 1 to 8, wherein said reset pulse voltage is a positive pulse voltage having the same pulse width as said anode pulse voltage, the first one of said cathode pulse voltages being applied for each frame to the first phase of the p-phase electrode connections of said first electrode group inphase with said reset pulse voltage, and the first of said anode pulse voltages being applied for each frame to the first phase of the m-phase electrode connections of said second electrode group with its phase delayed from the phase of said reset pulse voltage of T/N, whereby said reset discharge is generated by said pulse voltage and the first one of said cathode pulse voltage.

10. A method according to any one of claims 1 to 8, wherein the number of pulses in said anode pulse voltages applied to said second electrode group is limited to control the display of information.

11. A method according to claim 9, wherein the number of pulses in said anode pulse voltages appled to said second electrode group is limited to control the display of information.

* * * * *